US005605139A

United States Patent [19]

Orwoll

[11] Patent Number: 5,605,139

[45] Date of Patent: Feb. 25, 1997

[54] TARGET TRAP

[75] Inventor: Erik G. Orwoll, Holmen, Wis.

[73] Assignee: Blount, Inc., Montgomery, Ala.

[21] Appl. No.: 324,412

[22] Filed: Oct. 17, 1994

[51] Int. Cl.[6] ..... F41J 9/22

[52] U.S. Cl. ..... 124/8

[58] Field of Search ..... 124/6, 7, 8, 36

[56] References Cited

U.S. PATENT DOCUMENTS

| | | | |
|---|---|---|---|
| 829,963 | 9/1906 | Haughawout | 124/8 |
| 2,267,525 | 12/1941 | Kemp | 124/46 |
| 2,432,446 | 12/1947 | Rutherford et al. | 124/8 |
| 2,455,661 | 12/1948 | Du Pont | 124/8 |
| 2,711,163 | 6/1955 | Richardson | 124/8 |
| 3,971,357 | 7/1976 | LaPorte et al. | 124/8 |
| 4,005,695 | 2/1977 | Alday et al. | 124/8 |

*Primary Examiner*—John A. Ricci
*Attorney, Agent, or Firm*—Klarquist Sparkman Campbell Leigh & Whinston, LLP

[57] ABSTRACT

A target trap having a ratchet and pawl mechanism for partial recocking after a target has been thrown is disclosed. The trap includes a frame having a stationary ratchet wheel with contiguous ratchet teeth along a portion of the perimeter of the ratchet wheel. A biased pawl is mounted onto a throwing arm assembly for interacting with the ratchet wheel to hold the throwing arm assembly in a partially cocked position after the trap has been fired. The ratchet and pawl mechanism is arranged such that the throwing arm assembly can always be rotated in one direction so that an operator can move the throwing arm assembly into a cocked position. From the cocked position the throwing arm can move freely in the opposite direction to throw the target. After the target is thrown, the throwing arm recoils and rotates back in the one direction until the kinetic energy of the throwing arm is converted into potential energy in the spring, at which point the pawl engages the teeth of the ratchet wheel and prevents the throwing arm from rotating in the opposite direction. In this manner, the rotational momentum of the throwing arm assembly is used to partially recock the throwing arm for subsequent operations.

27 Claims, 6 Drawing Sheets

TARGET TRAP

BACKGROUND OF THE INVENTION

1. Field of the Invention

This invention pertains to the field of target traps used by shooters to hurl targets for shooting practice.

2. Description of the Related Art

Gun enthusiasts use target traps to throw targets, such as clay pigeons, into the air for shooting practice. Most portable target traps use a spring-loaded throwing arm that is cocked into a retracted position and held in place by a trigger. In the retracted position, the spring is stretched so as to store substantial potential energy. Upon actuation of the trigger, the arm is freed to move under the spring force. A target, previously loaded onto the throwing arm, will ride along a guide rail until the throwing arm reaches a throwing position, at which point the target will be thrown from the throwing arm into the air.

In their most basic configuration, target traps pivot freely on a base frame. After throwing a target, the throwing arm will oscillate until the spring is relaxed and the throwing arm is in a neutral position. In order to cock the throwing arm, an operator must grasp the frame and the arm and pivot the arm about the frame through approximately 180° in order to stretch the spring and position the arm in the trigger mechanism. This operation requires some strength and can obviously become more difficult to perform after sequential repetition.

One prior art solution that eased the difficulty of cocking required that the throwing arm be mounted on a pivot assembly having a clutch mechanism. Under this solution, the throwing arm would always move in one direction only, e.g., the counterclockwise (CCW) direction. After throwing the target, the arm would continue forward CCW under its momentum until the kinetic energy of the arm is converted into potential energy in the spring. The clutch assembly then prevents recoil of the throwing arm in the clockwise (CW) direction. Thus, for example, if a throwing arm were cocked in a six o'clock position (i.e., pointing back towards an operator) and thereafter fired, the throwing arm would throw the target at approximately the 12 o'clock position. Thereafter, the momentum of the throwing arm would continue carrying it forward in the CCW direction until the kinetic energy of the throwing arm had been converted to potential energy in the spring at approximately the nine o'clock position where it would be held by the clutch. Thus, the throwing arm would be one-quarter to three-quarters cocked. To complete cocking, the operator would simply rotate the throwing arm CCW from the nine o'clock position into the six o'clock position.

Although the use of clutches adequately addressed the problems noted above, they are expensive and, because of a greater number of moving parts, they are subject to failure.

SUMMARY OF THE INVENTION

The present invention solves the above-noted deficiencies by providing a throwing trap that partially self-cocks by means of a ratchet and pawl assembly. Preferably, the present invention includes a tripod stand supporting a frame assembly, a mainspring, and a throwing arm. Mounted onto the frame is a stationary ratchet wheel having ratchet teeth partially around the perimeter thereof. Mounted onto the throwing arm assembly is a spring-biased pawl that can engage the teeth of the ratchet wheel when properly oriented. In the preferred embodiments, the ratchet wheel and pawl are arranged such that the pawl will engaged the teeth of the ratchet wheel only after the throwing arm has completed its throwing motion and recoiled in the opposite direction toward the cocked position. The ratchet and pawl never restrict movement of the throwing arm as it is being cocked, nor do they prevent throwing motion rotation when the throwing arm begins rotation from the cocked position.

Various advantages and features of novelty which characterize the invention are particularized in the claims forming a part hereof. However, for a better understanding of the invention and its advantages, reference should be had to the drawings which form a part hereof and to the accompanying descriptive matter in which there is illustrated and described preferred embodiments of the invention.

DETAILED DESCRIPTION OF THE PREFERRED EMBODIMENTS

Figure 2:
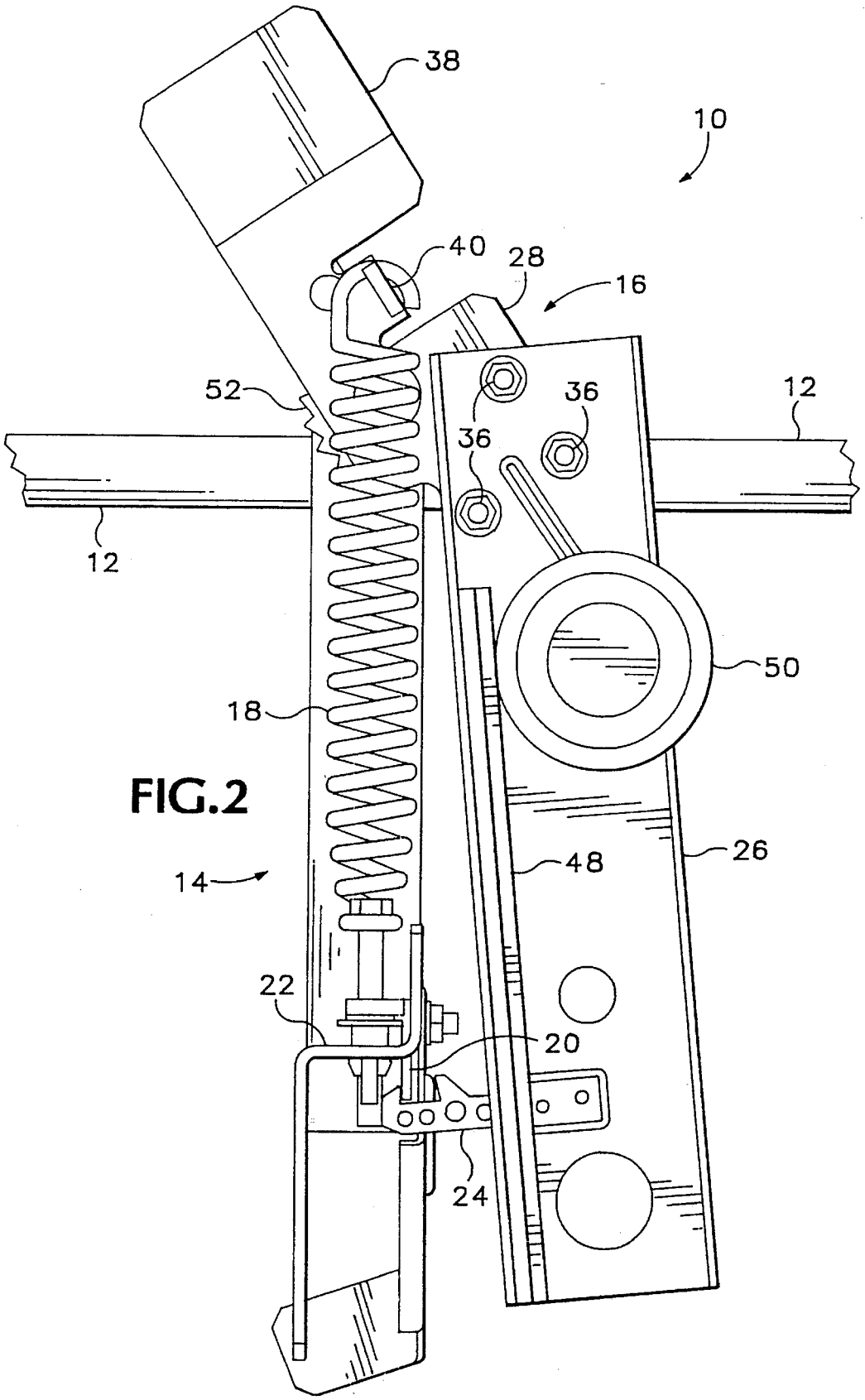
FIG. 2 is an enlarged top plan view of the throwing trap of FIG. 1 further showing a throwing arm in a cocked position.

With reference to the accompanying Figures, there is shown a preferred embodiment of a throwing trap 10 of the present invention. The throwing trap includes a tripod stand 12 supporting a frame assembly 14, a throwing arm assembly 16 and a mainspring 18. The frame assembly further includes a trigger mechanism 20 and a spring support 22. In FIG. 2, the arm assembly 16 is shown in a cocked position wherein a trigger latch 24 is engaged with the trigger mechanism 20. When the arm assembly 16 is cocked, the mainspring 18 is tensioned so as to store potential energy which can be used to move the arm assembly 16 when the trigger latch 24 is released from the trigger mechanism 20.

The arm assembly 16 includes a throwing arm 26, an arm support 28 and a pawl 30 having a biasing spring 32. The arm support 28 is pivotally mounted to the frame assembly 14, preferably by a pivot shaft 34 that is fixedly connected to the arm support 28 and rotatably received within a suitable bore (not shown) in the frame assembly 14. The throwing arm 26 is fixedly attached to the arm support 28 by mechanical fasteners, such as bolts 36. The arm support further includes a counterweight 38 and an upturned finger 40 for connection to the mainspring 18.

The pawl 30 is preferably an elongate member that is pivotally mounted to the arm support 28 on pivot shaft 42. The pawl 30 further includes a tooth-engaging tip 44, a nearby beveled edge 46 and leading edge 47. The pawl 30 is maintained in approximate longitudinal alignment with the arm support 28 by biasing spring 32, which is connected to the pawl at an end opposite the pawl tip 44.

The throwing arm 26 further includes a guide rail 48 for guiding a target 50 during throwing. The throwing arm may further include target clips (not shown) for holding the target and adjustments (not shown) which may be operated to influence the flight path of the target 50 during the throwing procedure. The throwing arm 26 also includes the trigger latch 24, which operably connects to the trigger mechanism 20 for holding the arm 26 in its cocked position as shown in FIG. 2.

The frame assembly 14 includes connection means (not shown) for attaching to the stand 12 and connections for the spring support 22 and trigger mechanism 20.

Also mounted on the frame assembly 14 is a ratchet wheel 52 that is fixedly mounted relative to frame assembly 14 about the pivot shaft 34 for the arm support 28. The ratchet wheel includes a plurality of teeth 54 located contiguously along a portion of the perimeter of the wheel 52, thus defining an engagement zone that is coincident with the location of the teeth. The ratchet wheel 52 of the present invention, does not have teeth completely along the entire perimeter of the wheel. Preferably, the teeth 54 of the present invention are located approximately equidistant from a center of rotation 56 of the arm assembly 16. Further, in the preferred embodiment, the body of the ratchet wheel 52 is cut away where no teeth 54 are present. Alternative embodiments could include a ratchet wheel having greater or lesser amount of cutaway portions which would still be operable within the concept of the present invention.

In the preferred embodiment, the ratchet wheel 52 of the present invention includes ratchet teeth 54 that are contiguous along an angular region of approximately 120°, thus establishing a 120° engagement zone. A ratchet wheel having teeth contiguous along a greater or lesser angular region is also contemplated to be within the scope of the present invention. However, the angular region having teeth, and thusly the engagement zone, are limited by physical considerations. Namely, the pawl 30 must be able to clear the teeth at the extreme ends of the path of motion of the arm assembly.

Preferably, the teeth 54 are asymmetrically sloped to provide a shallow slope along the counterclockwise direction and to provide a steep slope along the clockwise direction. Thus, the pawl 30 encounters minimum resistance when the arm assembly 16 moves clockwise yet is held fast when it engages against counterclockwise movement.

Figure 3:
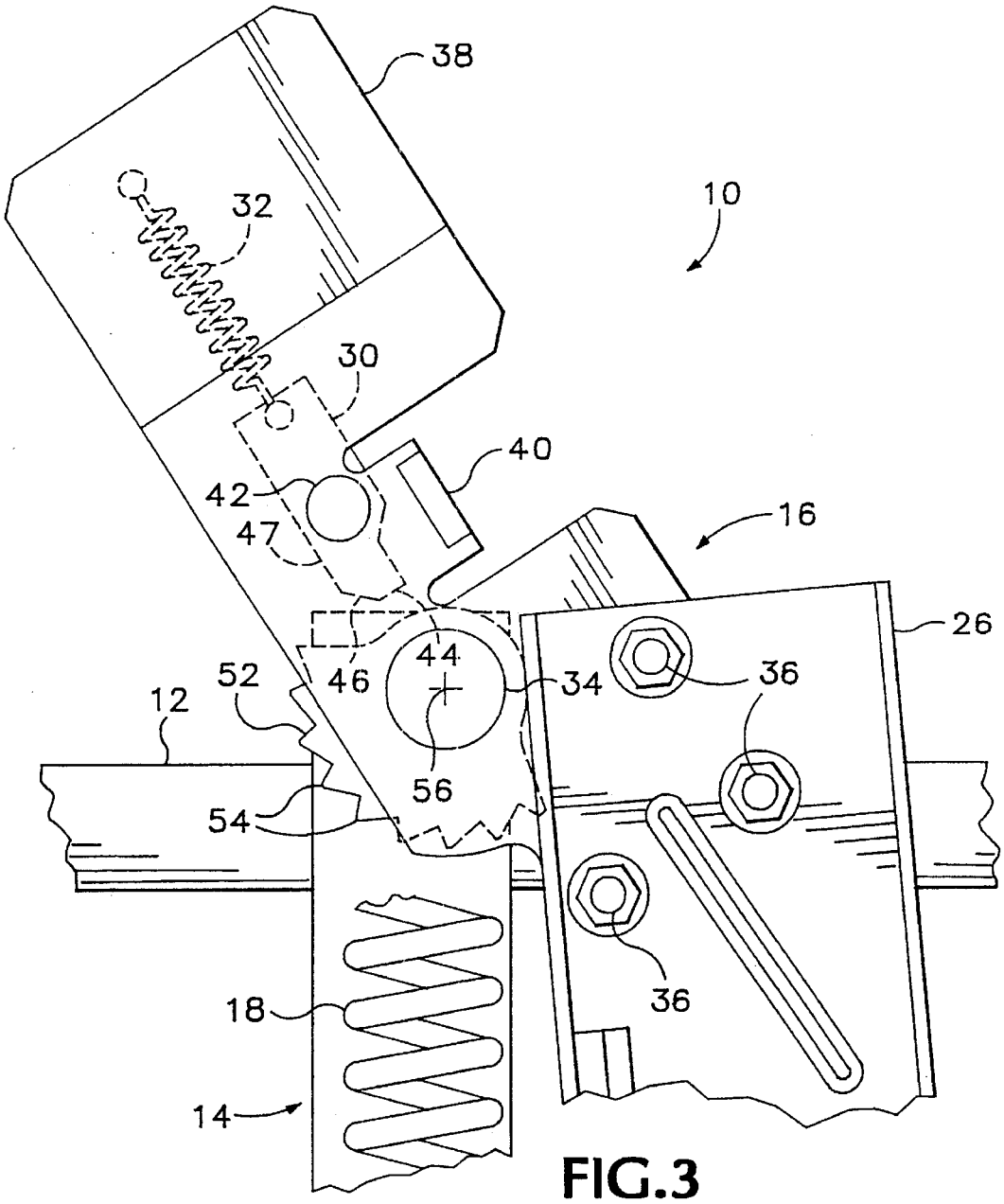
FIG. 3 is a detailed top plan view of the throwing trap of FIG. 1 wherein a mainspring has been cut away to reveal a ratchet mechanism.

With regard to the above description and FIGS. 3–6, the operation of the trap 10 of the present invention is described. In FIG. 3 there is shown a trap 10 wherein the arm assembly 16 has been cocked and the trigger latch 24 connected to the trigger mechanism 20 to hold the arm assembly 16 in the cocked position. For clarity of description, reference shall be made to clock positions. Thus, the cocked position, wherein the throwing arm is restrained back along the frame assembly 14, as shown in FIG. 2, shall be referred to as the 6 o'clock position. Accordingly, when the arm is rotated 180° to its throwing position, it shall be referred to as being in the 12 o'clock position.

When the arm is cocked, the mainspring 18 is stretched, or elongated, so as to create potential energy which can be used to move the throwing arm assembly 16. Recall that the ratchet wheel 52 is fixedly located with respect to the frame assembly 14, and that the pawl 30 is biased and pivotally mounted to the arm support 28. In the cocked configuration shown in FIG. 3, the arm has been rotated whereby the pawl 30 is past the engagement zone and not engaged with the teeth 54. When the arm is cocked, the pawl is biased into approximate longitudinal alignment with the ratchet wheel 52, and the pawl tip 44 is pointing generally toward a center of rotation 56. The tip 44 is now located within a recessed region of the ratchet wheel 52.

Figure 4:
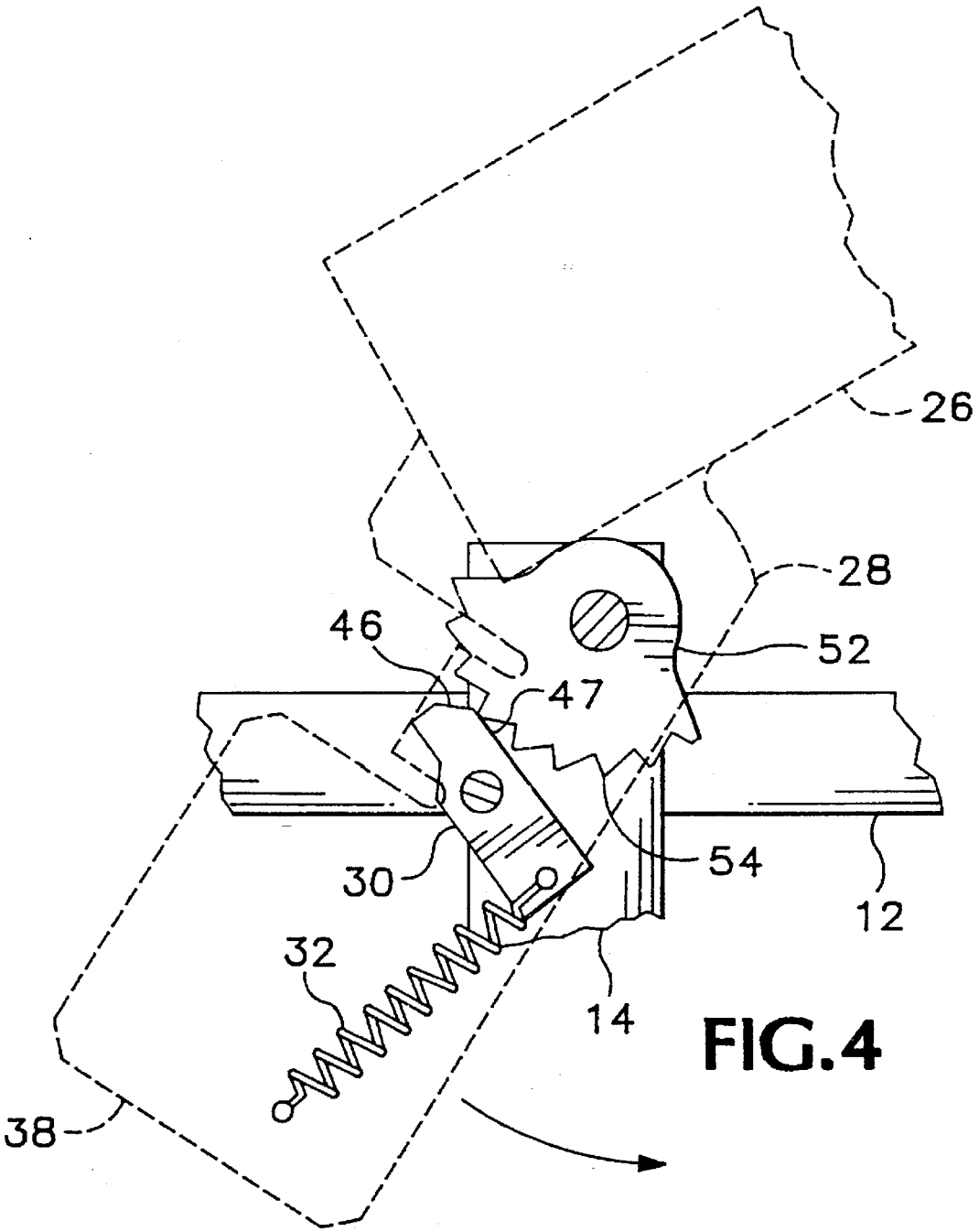
FIG. 4 is a top plan view showing detail of the ratchet mechanism as the throwing arm proceeds through its throwing motion.

When the throwing arm 26 is in this cocked position, a target 50 is thereafter loaded on the throwing arm and the trigger mechanism 20 operated to release the trigger latch 24. The mainspring 18 pulls against the finger 40, causing the arm assembly 16 to rotate about its pivot shaft 34 in a CCW direction. As the arm assembly 16 moves in the CCW direction the leading edge 47 of the pawl 30 contacts the teeth 54, causing the pawl 30 to pivot about its pivot pin 42, as is shown in FIG. 4. As the arm assembly 16 continues to rotate in a CCW direction, the leading edge 47 bumps along the teeth 54 of the ratchet wheel 52, allowing the arm assembly 16 to rotate freely.

Figure 5:
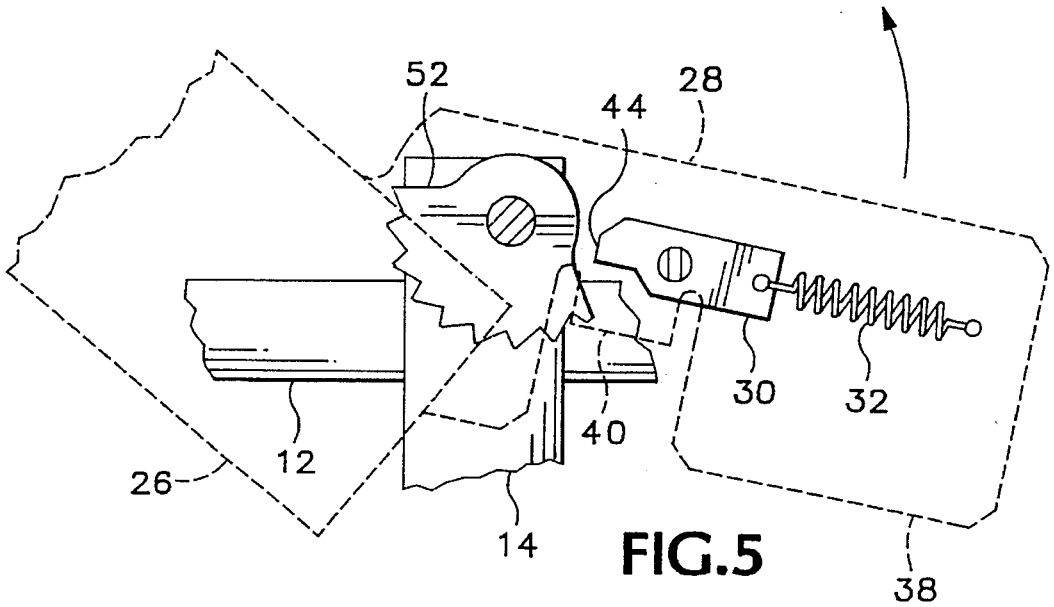
FIG. 5 is a top plan view showing detail of the ratchet mechanism as the throwing arm proceeds through its motion.

When the throwing arm 26 is approximately at the 12 o'clock position, the target is ejected from the throwing arm 26 by centrifugal force. Thereafter, as the arm continues to proceed in the CCW direction, the tip 44 of the pawl 30 will clear the row of teeth 54 of the ratchet wheel 52, and the tip 44 will enter a recessed region of the wheel so that the pawl 30 is free to rotate. The bias spring 32 then causes the pawl 30 to return to substantial longitudinal alignment with the center of rotation 56, as shown in FIG. 5.

As the arm assembly 16 continues rotating CCW past the 12 o'clock position it will begin to encounter resistance from the mainspring 18. Continued rotation in the CCW direction by the arm assembly 16 will elongate the mainspring 18 and store potential energy in the mainspring until all the kinetic energy associated with the rotation of the arm assembly 16 is spent. The arm will then recoil CW and the potential energy from the mainspring 18 is converted back into rotational kinetic energy of the arm assembly 16.

Figure 6:
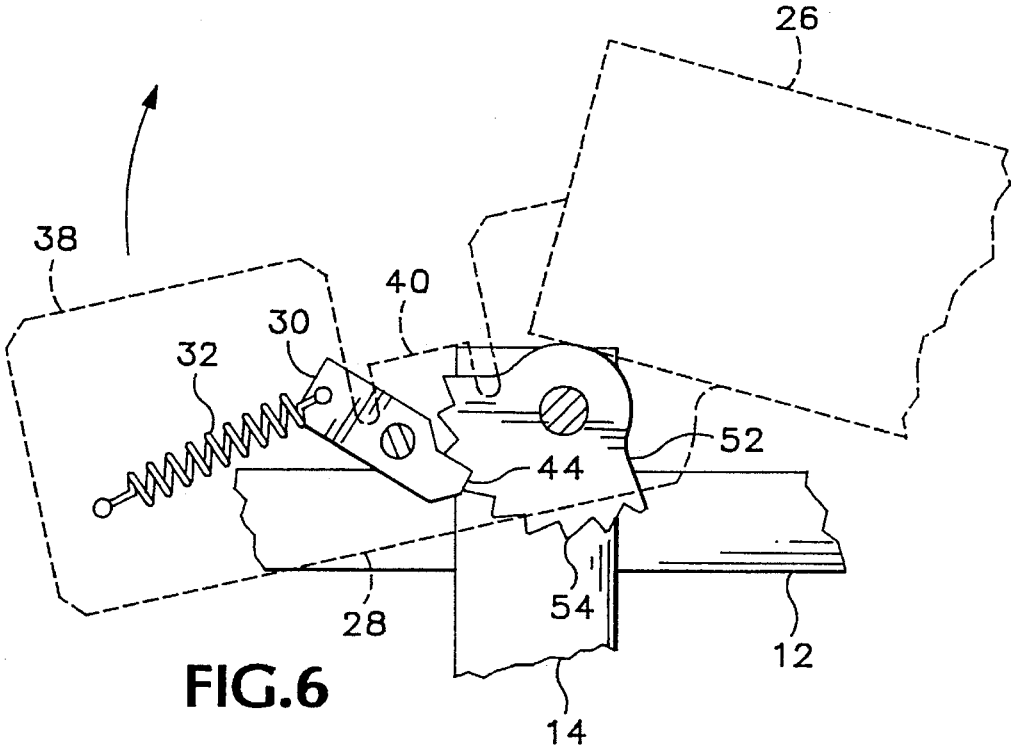
FIG. 6 is a detailed top plan view of the rachet mechanism of the present invention wherein the pawl is engaged with the ratchet wheel.
Figure 7:
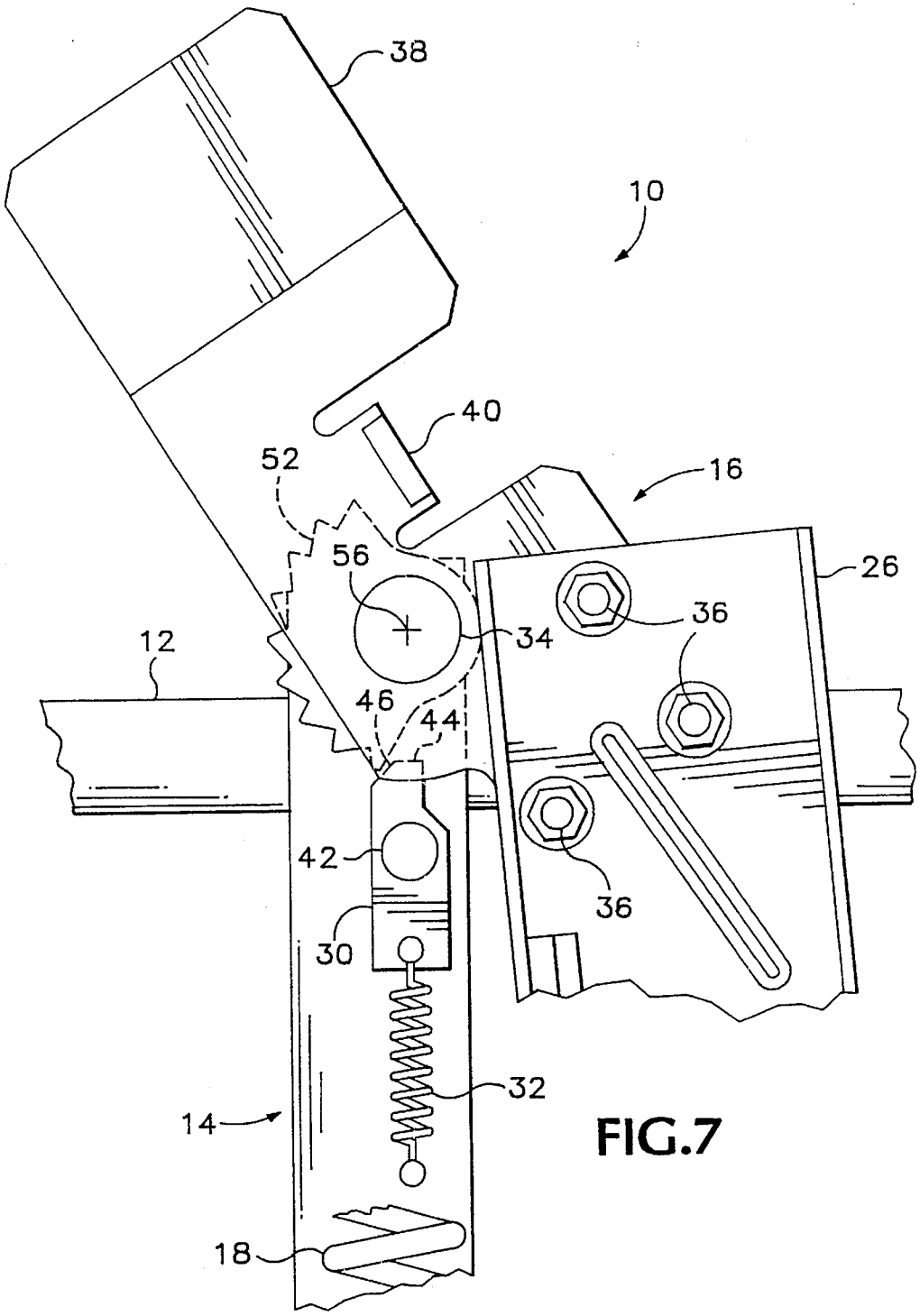
FIG. 7 is a top plan view showing detail of an alternative embodiment of the throwing trap of the present invention.

As the arm assembly 16 rotates CW, it enters the engagement zone where the tip 44 of the pawl 30 engages the teeth 54 in a conventional ratchet and pawl manner, as is shown in FIG. 6. The arm assembly 16 will continue rotating CW until all the rotational kinetic energy of the arm assembly 16 is converted into potential energy in the mainspring 18 (except for energy dissipated by the system, such as friction). The mainspring 18 will then have potential energy that will attempt to rotate the arm assembly 16 back towards the CCW direction. However, because the tip 44 of the pawl 30 will be engaged with one of the plurality of teeth 54 as shown in FIG. 6, it will prevent CCW rotation of the throwing arm assembly 16. In this manner, the arm assembly 16 will be partially cocked in approximately the 2 to 4 o'clock position after every operation of the trap. Thereafter, an operator can fully cock the arm assembly by grasping the throwing arm 26 and rotating it in a CW direction from the pre-cocked position until the trigger latch 24 engages the latch mechanism 20. A target 50 may then be loaded and the operation repeated.

Figure 1:
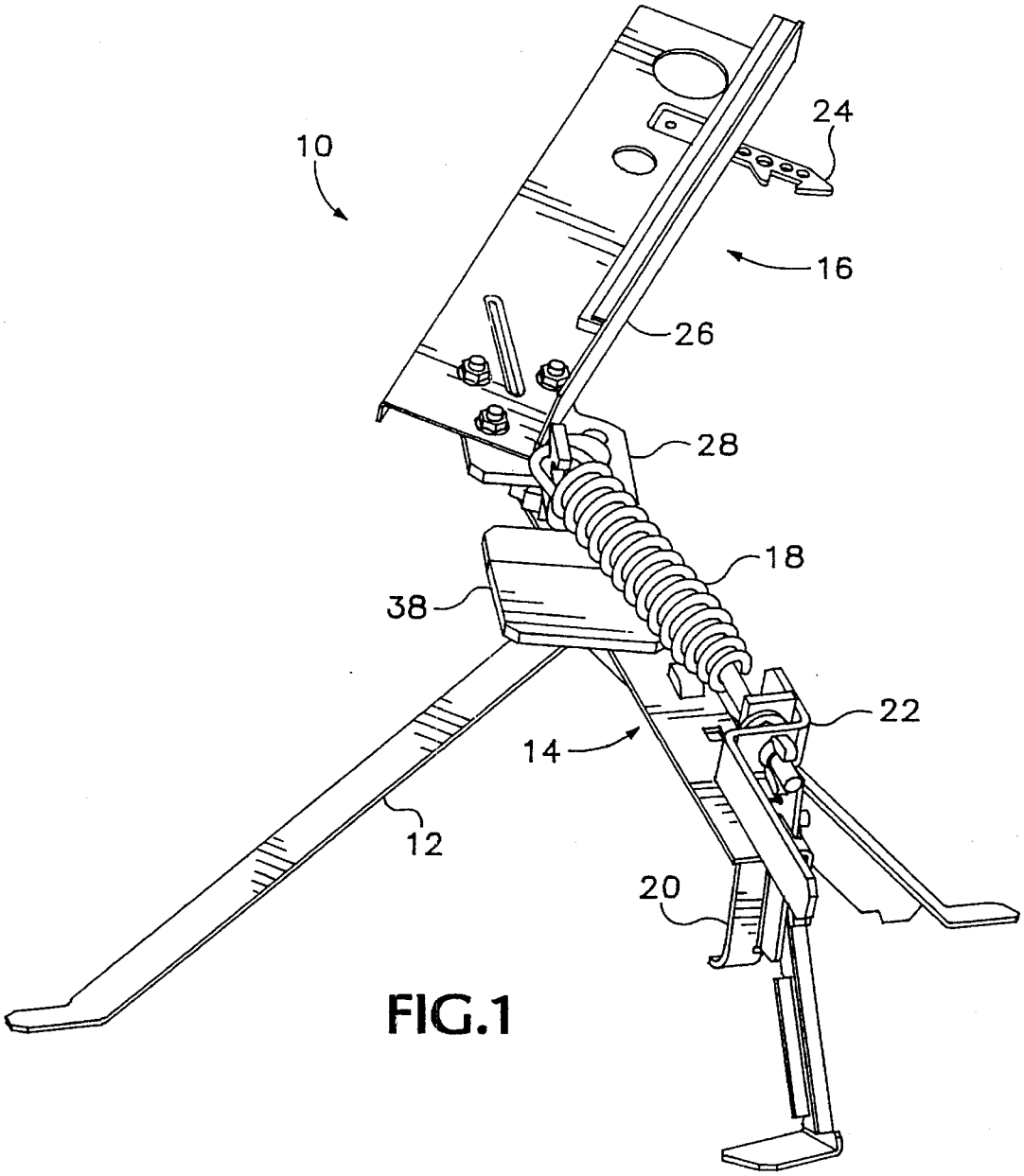
FIG. 1 is a perspective view of a preferred embodiment of a throwing trap of the present invention.

It must be noted that during the first operation of the trap, the arm 26 will not be partially cocked. Conversely, the arm assembly 16 will be in a position approximately as shown in FIG. 1. Thus, for the initial operation, the operator must pull the arm assembly 16 through an arc of approximately 180°.

The above description disclosed an embodiment in which the pawl 30 is mounted to the arm support 28 and the ratchet wheel 52 is mounted to the frame assembly 14. Alternative embodiments include mounting the pawl 30 on the frame assembly 14 and mounting the ratchet wheel 52 on the arm assembly 16. Additionally, alternative embodiments could include mounting the ratchet wheel 52 so that it is rotatable and biased in a particular orientation and mounting the pawl 30 so that it is fixed.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, direction of rotation and arrangement of parts within the principle of the invention to the full extent indicated by the broad general meaning of the terms in the claims.

I claim:

1. A target trap, comprising:

(a) a frame;

(b) an arm pivotally attached to the frame for rotational movement along an arc;

(c) a potential energy storage device for urging the arm in a first rotational direction; and (d) a ratchet mechanism that permits the arm to rotate in the first rotational direction when the arm begins motion from a cocked position and that arrests the motion of the arm against rotation in the first rotational direction when the arm changes rotational direction from a second direction to the first direction within an engagement zone that forms an angular part of a rotational arc of motion of the arm.

2. The target trap of claim 1 wherein the ratchet mechanism comprises an arcuate ratchet and a pawl.

3. The target trap of claim 2 wherein the ratchet includes a plurality of teeth arranged contiguously throughout an arc having an angular size that is equal to an angular size of the engagement zone.

4. The target trap of claim 2 wherein the ratchet is fixedly attached to the frame.

5. The target trap of claim 4 wherein the pawl is rotatably attached to the arm.

6. The target trap of claim 5 further including a bias member connected to the pawl for urging the pawl into selected alignment with respect to the arm.

7. The target trap of claim 2 wherein the ratchet wheel is fixedly attached to the arm.

8. The target trap of claim 7 wherein the pawl is rotatably attached to the frame.

9. The target trap of claim 8 further including a bias member connected to the pawl for urging the pawl into alignment with respect to the frame.

10. The target trap of claim 1 wherein the potential energy storage device is a spring.

11. The target trap of claim 1 wherein the arm includes a counter balance.

12. The target trap of claim 1 further including a trigger catch that holds the arm against rotational motion in the first rotational direction, the trigger catch located so as to catch and hold the arm when the arm is outside the engagement zone.

13. The target trap of claim 1 wherein the arm has a first position wherein the potential energy storage device stores a first potential energy and the arm has a second position wherein the arm stores a second potential energy that is greater than the first potential energy and the engagement zone is located between the first and second positions of the arm.

14. A target trap, comprising:

(a) a frame;

(b) an arm pivotally attached to the frame wherein the arm pivots about the frame along a rotational arc;

(c) a spring connected to the arm for urging the arm in the first rotational direction of motion;

(d) a ratchet wheel connected to the frame; and (e) a pawl connected to the arm and operably engaged with the ratchet wheel wherein the arm can be actuated to move so as to propel a target and thereafter the spring reverses direction of the arm motion and the pawl engages the ratchet wheel to at least partially cock the arm.

15. The target trap of claim 14 further comprising a bias member attached to the pawl for urging the pawl into an alignment with respect to the ratchet wheel.

16. The target trap of claim 15 wherein the bias member urges the pawl into engagement with a ratchet tooth on the ratchet wheel when the arm is in an engagement zone forming a portion of the rotational arc and the arm has changed direction of motion from the first direction of motion to the second direction of motion.

17. The target trap of claim 14 wherein the ratchet wheel includes a plurality of teeth arranged contiguously along an edge of the ratchet wheel forming a toothed region having an angular size of less than 180°.

18. The target trap of claim 14 wherein the ratchet wheel is located about a center of rotation of the arm.

19. The target trap of claim 14 wherein the pawl is pivotally connected to the arm.

20. The target trap of claim 14 wherein the ratchet wheel is fixedly connected to the frame.

21. A target trap, comprising:

(a) a frame;

(b) an arm pivotally attached to the frame;

(c) a potential energy storage device connected to the frame and the arm for imparting motion to the arm when the arm is unrestricted; and (d) a ratchet mechanism;

(e) wherein the potential energy storage device is operable to move the arm in a first direction to throw a target from the trap and thereafter to move the arm in a second direction until all kinetic energy associated with arm movement is dissipated at which time the ratchet mechanism engages to hold the arm in a pre-cocked position.

22. The target trap of claim 21 wherein the potential energy storage device is a mechanical spring.

23. The target trap of claim 22 wherein the potential energy storage device is a helical spring attached to the arm at a location spaced from the center of pivot of the arm.

24. A target trap, comprising:

(a) a frame;

(b) a throwing arm rotatably attached to the frame for rotation about a pivot;

(c) a mechanical spring attached to the frame and the throwing arm at a location other than the pivot for imparting rotational motion to the throwing arm; and (d) a ratchet mechanism operatively interconnecting the throwing arm and the frame and including a biased pawl and an arcuate ratchet having a plurality of ratchet teeth contiguous along an angular region for engaging the pawl when the throwing arm reverses direction and the pawl is contacting the ratchet thereby at least partially cocking the throwing arm and wherein the throwing arm can be fully cocked such that the pawl is disengaged from the ratchet teeth.

25. The target trap of claim 24 wherein the ratchet teeth are asymmetrically shaped to provide a steep slope on a first side of the teeth and a relatively lesser slope on a second side of the teeth.

26. The target trap of claim 24 wherein angular region of the ratchet teeth is less than 150 degrees and greater than 90 degrees.

27. The target trap of claim 24 further including a counterweight fixedly connected to the throwing arm.

* * * * *